US010921105B2

(12) United States Patent
Kezerian et al.

(10) Patent No.: US 10,921,105 B2
(45) Date of Patent: Feb. 16, 2021

(54) PRODUCT AND METHOD TO DECREASE TORSIONAL LOADS INDUCED IN SABOTS AND RIDERS IN RIFLED GUN BORES

(71) Applicant: Simulations, LLC, East Granby, CT (US)

(72) Inventors: Jeffrey M Kezerian, East Granby, CT (US); James E. Abitabilo, Bristol, CT (US)

(73) Assignee: Simulations, LLC, East Granby, CT (US)

( * ) Notice: Subject to any disclaimer, the term of this patent is extended or adjusted under 35 U.S.C. 154(b) by 27 days.

(21) Appl. No.: 16/004,114

(22) Filed: Jun. 8, 2018

(65) Prior Publication Data

US 2019/0017792 A1 Jan. 17, 2019

Related U.S. Application Data

(63) Continuation-in-part of application No. 62/517,317, filed on Jun. 9, 2017.

(51) Int. Cl.
*F42B 14/06* (2006.01)

(52) U.S. Cl.
CPC ..... *F42B 14/064* (2013.01); *F42B 14/067* (2013.01)

(58) Field of Classification Search
CPC ..... F42B 14/064; F42B 14/067
USPC ..... 102/522
See application file for complete search history.

(56) References Cited

U.S. PATENT DOCUMENTS

| | | | | | |
|---|---|---|---|---|---|
| 3,738,279 | A | * | 6/1973 | Eyre | F42B 14/02 102/521 |
| 3,802,345 | A | | 4/1974 | La Costa | |
| 4,187,783 | A | * | 2/1980 | Campoli | F42B 14/061 102/520 |
| 4,296,687 | A | | 10/1981 | Garrett | |
| 4,535,698 | A | * | 8/1985 | Yuen | F42B 8/14 102/521 |
| H403 | H | * | 1/1988 | Glasser | 102/374 |
| H941 | H | * | 8/1991 | Wyluda | 102/514 |
| 5,259,321 | A | | 11/1993 | Pahnke | |

(Continued)

OTHER PUBLICATIONS

John Tsibouklis and Thomas G. Nevell; Ultra-Low Surface Energy Polymers: The Molecular Design Requirements; Advanced Materials; Apr. 17, 2003; 647-650; Wiley, Weinheim.

*Primary Examiner* — Michelle Clement
(74) *Attorney, Agent, or Firm* — UConn IP Law Clinic; Nestor Rodriguez Smyt; Jesse Mangiardi

(57) ABSTRACT

Disclosed herein is sabot for a sub-caliber projectile comprising a plurality of petals, such that a slip mechanism can be incorporated between the sabot petals and the pusher mechanism to decrease or prevent the sabot from rotating in a rifled gun bore, or the petals themselves can be separated into forward petals and aft petals, with only the aft petals rotating along with the gun rifle. When separate forward petals and aft petals are used, the torque transferred to the forward petals is greatly reduced, thus decreasing the angular rotation of the forward petals with the intent of preventing the forward petals from rotating. The slip mechanism has slip plates with low-coefficient of friction surfaces configured to contact adjacent slip plates prior to and during launch. As assembly, a system, and corresponding methods also are disclosed.

20 Claims, 4 Drawing Sheets

(56) References Cited

U.S. PATENT DOCUMENTS

| | | | | |
|---|---|---|---|---|
| 6,655,293 | B1 * | 12/2003 | Henry | F42B 10/06 102/439 |
| 6,782,830 | B1 * | 8/2004 | Candland | F42B 14/02 102/439 |
| 6,783,095 | B1 * | 8/2004 | King | F42B 10/14 102/377 |
| 6,829,997 | B1 | 12/2004 | Hilleman | |
| 7,594,472 | B1 * | 9/2009 | Parratt | F42B 14/061 102/520 |
| 7,935,208 | B2 | 5/2011 | Park et al. | |
| 8,142,586 | B2 | 3/2012 | Park et al. | |
| 8,561,544 | B2 | 10/2013 | Baumann et al. | |
| 8,678,042 | B2 | 3/2014 | Quigley et al. | |
| 8,695,507 | B1 * | 4/2014 | Musali | F42B 14/061 102/521 |
| 8,887,641 | B1 * | 11/2014 | Manole | F42B 14/06 102/521 |
| 8,931,416 | B2 * | 1/2015 | Schneider | F42B 12/60 102/449 |
| 9,052,173 | B2 | 6/2015 | Minnicino, II | |
| 2010/0276082 | A1 | 11/2010 | Park et al. | |
| 2011/0214582 | A1 * | 9/2011 | Glasser | F42B 12/44 102/439 |
| 2016/0102953 | A1 * | 4/2016 | Kalifa | F42B 14/064 102/521 |
| 2016/0282094 | A1 | 9/2016 | Brown | |
| 2017/0146329 | A1 | 5/2017 | Scarr | |

* cited by examiner

PRODUCT AND METHOD TO DECREASE TORSIONAL LOADS INDUCED IN SABOTS AND RIDERS IN RIFLED GUN BORES

BACKGROUND

Sabots and riders are used in gun bores during firing (launching) to 'guide and carry' sub-caliber projectiles, as well as complex integrated launch packages (ILPs), during the entire in-bore launch event. One of the fundamental tasks of the sabot and riders is to keep the projectile centered laterally while in-bore, minimizing lateral movement, deflections and potential stresses. For many ILPs the sabot and riders also act as the axial load path and component that transfers the actual forces generated by the propellant gas to the projectile that accelerates the entire launch package. Sabots perform other functions such as housing the obturator (the main seal), which seals the propellant gases behind the launch package, preventing gas "blow-by" from leaking past the projectile. A sabot may also have an air scoop feature as part of its geometry which initiates the sabot discard upon muzzle exit.

While the sabot performs some or all of these functions, it must be structurally designed to withstand the high compressive and tensile stresses induced by its own inertia, as well as the inertial stresses induced by the projectile and other ILP masses during the entire launch event. When sabots are used in rifled guns there are the additional high torsional stresses due to the angular acceleration they undergo as a result of the rifling grooves. In the latter application with rifled bores, the sabot not only undergoes torsional stresses due to its own inertia being rotated, it also rotates the mass of other components, such as riders, that greatly add to the torsional stresses in the sabot.

It would be useful to develop improved lightweight composite sabots that can withstand the torsional stress induced in rifled bores.

SUMMARY

One embodiment disclosed herein is a sabot for a sub-caliber projectile comprising a plurality of petals, each having a forward end portion, an aft end portion, and an inner surface configured to contact the projectile when the sabot is in use, and a slip mechanism formed on the plurality of petals. The slip mechanism has a slip surface configured to contact an adjacent surface prior to launch and to enable at least a portion of each petal to rotate at a slower rate than the projectile upon during launch. In some cases, the plurality of petals include forward petals and aft petals, and the slip mechanism is disposed between the forward petals and the aft petals.

Another embodiment disclosed herein is an assembly comprising a sub-caliber projectile, and a sabot surrounding the projectile. The sabot comprises a plurality of forward petals and a plurality of aft petals, each petal having a forward end portion, an aft end portion, and an inner surface configured to contact the projectile. The assembly also includes a slip mechanism disposed between the forward petals and the aft petals, the slip mechanism having a first surface with a low coefficient of friction, the first surface being in contact with a surface that is configured to rotate at a different rate than the slip mechanism, and a pusher plate disposed proximate an aft end of the sabot.

A further embodiment is a method of providing a slip mechanism with a low coefficient of friction that removes, decreases, or isolates sabot petals from rotating in rifled bore guns at high angular accelerations. In embodiments, the projectile includes fins, and the sabot and slip mechanism system comprises forward petals and aft petals, wherein the slip mechanism separates the forward petals and the aft petals and isolates certain petals from rotating.

In embodiments, the projectile does not include fins and the sabot petals can be the entire length of the projectile or as functionally required, with only one set of petals. In some cases, the petals mate against the pusher inserts and it is at that location where the slip mechanism is integrated. The torsional stresses in the sabot petals are reduced due the slip mechanism.

In embodiments, at least one of the slip plate mechanism and the petals comprises reinforced fiber polymer composites. In some cases, at least some of the petals have open cross-sectional areas and in other cases at least some of the petals have closed cross-sectional areas.

Another embodiment described herein is a system comprising a plurality of sabot petals, including forward petals and aft petals separated by slip plates. In embodiments, at least one petal comprises a reinforced fiber polymer composite.

BRIEF DESCRIPTION OF THE DRAWINGS

Some of the disclosed embodiments are illustrated as examples and are not limited by the figures of the accompanying drawings, in which like references may indicate similar elements and in which.

DETAILED DESCRIPTION

Figure 1:
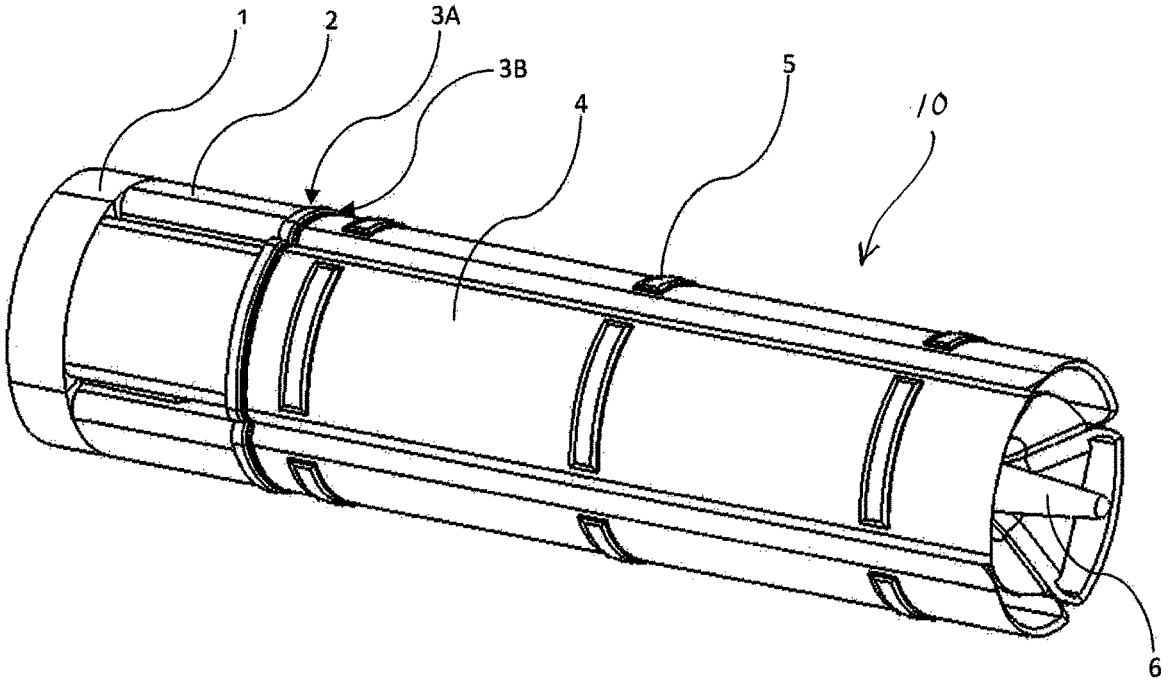
FIG. 1 is a front isometric view of a first embodiment of an integrated launch package.

Products and methods are described herein relating to a sabot comprising petals that include a slip mechanism. In some cases, forward petals and aft petals are separated by at least one slip mechanism. While in the illustrated embodiments the slip mechanism is a slip plate, other non-plate configurations can be used. In embodiments, the aft petals are shorter than the forward petals. Upon launch, the aft petals rotate at a faster rate than the corresponding forward petals.

The terminology used herein is for the purpose of describing particular embodiments only, and is not intended to be limiting. As used herein, the term "and/or" includes any and all combinations of one or more of the associated listed items. As used herein, the singular forms "a", "an", and "the", are intended to include the plural forms as well at the singular forms, unless the context clearly indicates otherwise. It will be further understood that the terms "comprises" and/or "comprising", when used in this specification, specify the presence of stated features, various types of closed cross-sectional areas, quantity of petals, varying cross-sections, various fiber architectures, various hybrid of materials, supporting hardware such as riders, pusher plates, and/or groups thereof.

Unless otherwise defined, all terms (including technical and scientific terms) used herein have the same meaning as commonly understood by one having ordinary skill in the art to which this disclosure belongs. It will be further understood that the terms, such as those defined in commonly used dictionaries, should be interpreted as having a meaning that is consistent with their meaning in the relevant and the present disclosure and will not be interpreted in an idealized or overly formal sense unless expressly so defined herein.

In describing these embodiments, it will be understood that a number of techniques are disclosed. Each of these has individual benefit and each can also be used in conjunction with one or more, or in some cases all, of the other disclosed techniques. Accordingly, for the sake of clarity, this description will refrain from repeating every possible combination of the various petal concepts. Nevertheless, the specification and claims should be read with the understanding that such combinations are entirely within the scope of the claims.

Definitions:

As used herein, the term "slip surface" refers to a low coefficient of friction surface that allows for adjacent surfaces to rotate at a different rate relative to one-another. The term "slip mechanism" refers to a component with a low coefficient of friction surface that is positioned adjacent to another component and that allows for the two components to rotate at different rates relative to one-another. The term "slip plate" refers to a thin, generally flat slip mechanism.

As used herein, the term "composite" means a material made from two or more constituent materials with significantly different physical or chemical properties that, when combined, produce a material with characteristics different from the individual components. The individual components remain separate and distinct within the finished structure, differentiating composites from mixtures and solid solutions. The new material may be preferred for many reasons: common examples include materials which are stronger, lighter, or less expensive when compared to traditional homogenous materials.

As used herein, the term "polymer composite" refers to a thermoplastic or thermoset set matrix, such as a resin, epoxy, ceramic, or plastic matrix that is filled with carbon, glass, boron, and/or other constituents. In some cases, the filler is a reinforcing material. In some cases, the filler is fibrous, forming a fiber-reinforced polymer (FRP). In other cases, the filler is used to adjust the weight of the component.

A "metal matrix composite" (MMC) as used herein refers to a material with a metal matrix, such as aluminum, titanium, magnesium, cobalt, or another metal, which is then filled with a different non-metallic or same material or organic compound, such as carbon, a glass, or a ceramic. In some cases, the filler is a reinforcing filler. In some cases, the filler is used to adjust the weight of the component.

A novel method to decrease the high torsional loads and stresses in sabots used in rifled guns is described herein, along with a new construction for sabots. In the following description, for purposes of explanation, numerous specific details are set forth in order to provide a thorough understanding of the disclosed embodiments.

As indicated above, the sabot is the device assembled around the outside of the projectile that keeps the projectile centered in the gun bore during launch. Since the sabot is discarded upon muzzle exit, it must be designed so it can separate itself from the projectile. This is commonly done by having the sabot made of at least two petals. It is more common to have three or four petals per sabot. When these petals are assembled around the projectile, it is the final assembly of petals that is referred to as the sabot. Upon muzzle exit these petals jettison away from the projectile, initiated by the stagnation pressure in the front of the sabot (developed in-bore during launch), and are then overtaken and fully discarded due to the high velocity air impacting and forcing petals radially outward once outside and unconstrained by the barrel. The other force that assists in discarding the petals from the projectile is the centrifugal force due to the sabot rotating in a rifled bore.

For guns and launch systems in which there are no rifling grooves in the bore, for example smooth-bore guns, torsional stiffness and torsional strength are not the structural properties driving the sabot design since these ILPs do not rotate. Although the devices, features, and methods described herein can be used in smooth-bore gun systems, e.g. for handling and loading systems, they are not required.

Decreasing the mass of sabots and riders is a desirable goal, and when using advanced materials such as composites to help lower mass, the benefits are significant when compared to conventional sabot materials such as aluminum. Conventional designs of composite sabots are not successful since the torsional loads require torsional stiffness and strength which realistically exceed the composite material shear and interlaminar strengths and rigidity limits, and/or are cost prohibitive to fabricate; thus composites have not yet been used in production and/or fieldable launch packages for rifled guns. The industry continues to use aluminum alloy and/or steel alloy materials for sabots in large caliber rifled bore guns.

In general, the density of aluminum alloys is about twice the density of carbon reinforced fiber polymer (CFRP) composites. Therefore, the use of composites in place of aluminum for a typical sabot reduces the sabot mass by about fifty (50) percent. Moreover, since the strength and stiffness of composites can be customized, a more efficient and optimized sabot geometry can be engineered with composites and the mass savings eventually exceed fifty percent. However, this novel approach originally developed with composites is applicable in aluminum, other metals, and/or any homogeneous material as well. The choice of material, mass savings and methods to approach the sabot design is a function of the ballistic complex variables such as projectile geometry, axial load path requirements, loader and handling requirements, rifling frequency (pitch) and design, setback, lateral, and torsional loads, bore size, costs, range, impact on target, etc. The present disclosure offers solutions to address the industry's current inability to use composites in rifled bores.

As is discussed above, a drawback of conventional aluminum sabots for launch packages in rifled bore guns is their mass. As technology moves forward, requiring higher velocities, increased accelerations, and the need for customized strengths and material properties, aluminum density and its homogenous material properties become limiting factors. Faster hypervelocity projectiles are desirable due to the advanced threats evolving in the world. In some cases, it is useful to replace aluminum with a lighter weight material so that increased projectile velocities resulting from greater in-bore accelerations can be achieved.

In the past, the military and defense agencies have been unable to exploit composites for sabots in integrated launch packages in rifled bores. The embodiments and devices described herein provide methods, a technique, and design approach to remove and isolate the sabot from previously limiting torsional loads. Having the sabot designed with composites according to some of the embodiments described herein provide the path to decrease the sabot mass by at least 50%. Being that the new design therefore isolates the sabot from torsional stresses, the sabot requires even less torsional stiffness and strength. By iteration, the reduced strength requirements allows for thinner walls, and less features which again decrease the sabot mass further, again reducing the inertially induced stresses which need to be borne, thereby reducing the volume of material needed. The iterations of mass reduction and therefore load reduction can continue until a practical limiting factor becomes apparent. Reducing the volume of materials required for the sabot package greatly decreases the cost of sabot production.

The embodiments described herein provide a method to drastically reduce the torsional stresses in the sabot, which in turn also reduces the increased compressive and tensile stresses that occur due to torsion and twisting in the sabot body. The disclosed embodiments allow for fiber reinforced polymer composites as the sabot material for medium, and especially for large caliber rifled guns. Non-limiting examples of suitable reinforced fiber polymer composites include polymers such as epoxy, polyester, and/or vinyl ester with fibers of carbon, glass, aramid or basalt.

This disclosure provides approaches to use lightweight composite sabots in rifled guns by isolating and/or removing the high torsional stresses from the sabot.

The novel product is referred to as a Slip-Sabot™. Its baseline approach is illustrated in two examples here with eight sabot petals or four sabot petals, yet the number of petals can be 2, 3, 4, 5 etc. The actual number of petals is determined pursuant to requirements of each launch package design.

The present disclosure is to be considered as an exemplification, and is not intended to limit the scope to the specific embodiments illustrated by the Figures or description herein.

Figure 6:
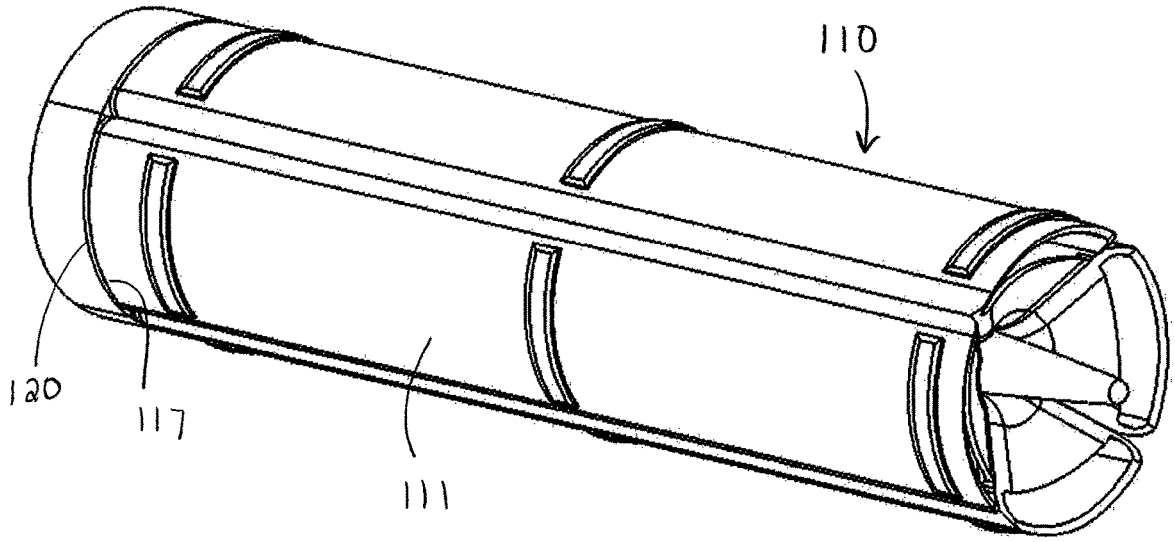
FIG. 6 is an isometric view of a second embodiment of a launch package that does not include fins on the projectiles.
Figure 7:
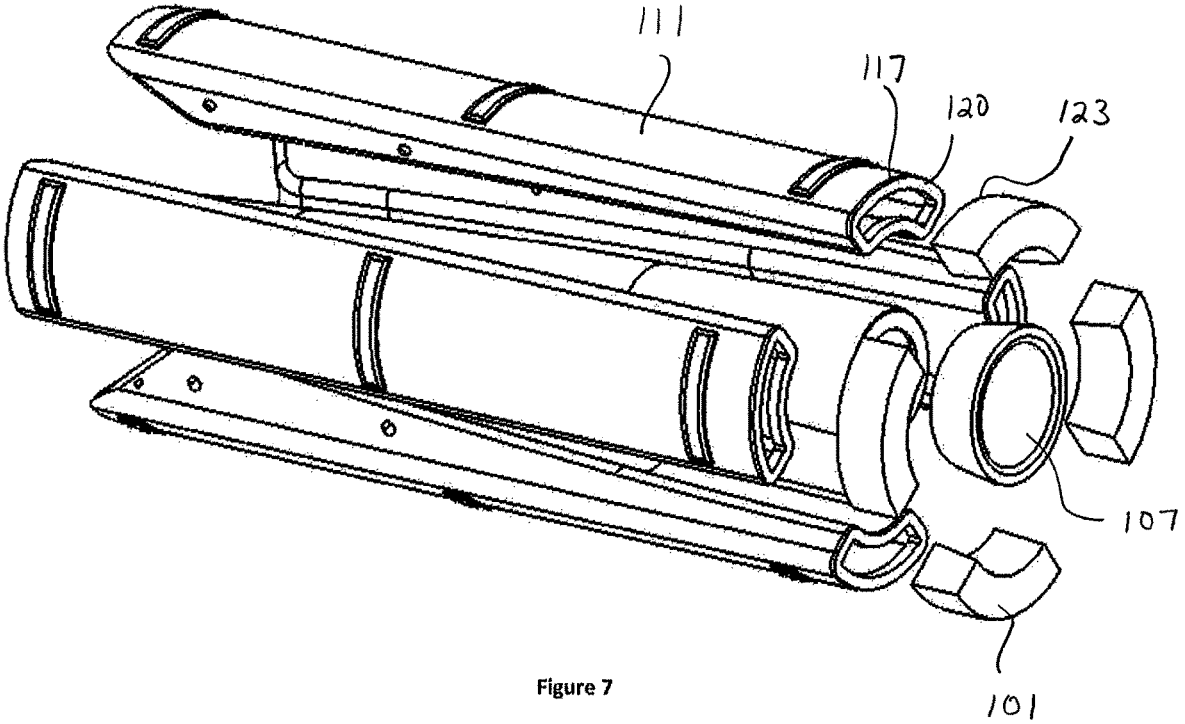
FIG. 7 shows an exploded view of the second embodiment, shown from the rear end.

Briefly stated, FIG. 1 illustrates a sabot as part of an integrated launch package for a rifled-bore gun. The sabot can also be used in smooth-bore guns, e.g. to assist in handling and for loading systems, yet is not necessary. The Insert Pushers 1, Aft Petals 2, Aft Slip Plates 3A, Forward Petals 4, Forward Slip Plates 3B, Riders 5, and Projectile 6 are shown. In this example, there are four insert pushers, four aft petals, four aft slip plates, four forward petals, four forward slip plates, twelve riders and one projectile. The view in FIG. 2 additionally shows the Pusher Plate 7. FIG. 3 depicts the Anti-Slip Pins 8 that assist in keeping the forward petals 4 aligned, coincident, and mated to each other during the entire in-bore launch event. FIG. 3 also highlights the essential hardware for this embodiment; the aft slip plates 3A and forward slip plates 3B. FIG. 4 is an exploded view highlighting the same features as shown in FIG. 3 from a different reference point. When assembled, as in FIGS. 1-2, aft slip plate 3A and forward slip plate 3B are mated to their interfacing surfaces and slip rotationally on those surfaces. It is those surfaces that are treated with very low coefficient of friction coating to facilitate the contacting surfaces to easily slide across t each other. FIGS. 6-7 also show another launch package, yet being that there are no fins on the projectile, the petals do not need distinct aft sets and forward sets of petals to protect the fins; there is just one set of petals in this example, one set of slip plates 120, and those petals slip against the pusher insert 101. In embodiments, the pusher insert 101 has its mating surface 123 that contacts the slip plate 120 treated with a low coefficient of friction coating, or the surface 123 has a slip plate formed thereon. In this embodiment the pusher plate is designated as 107.

Figure 2:
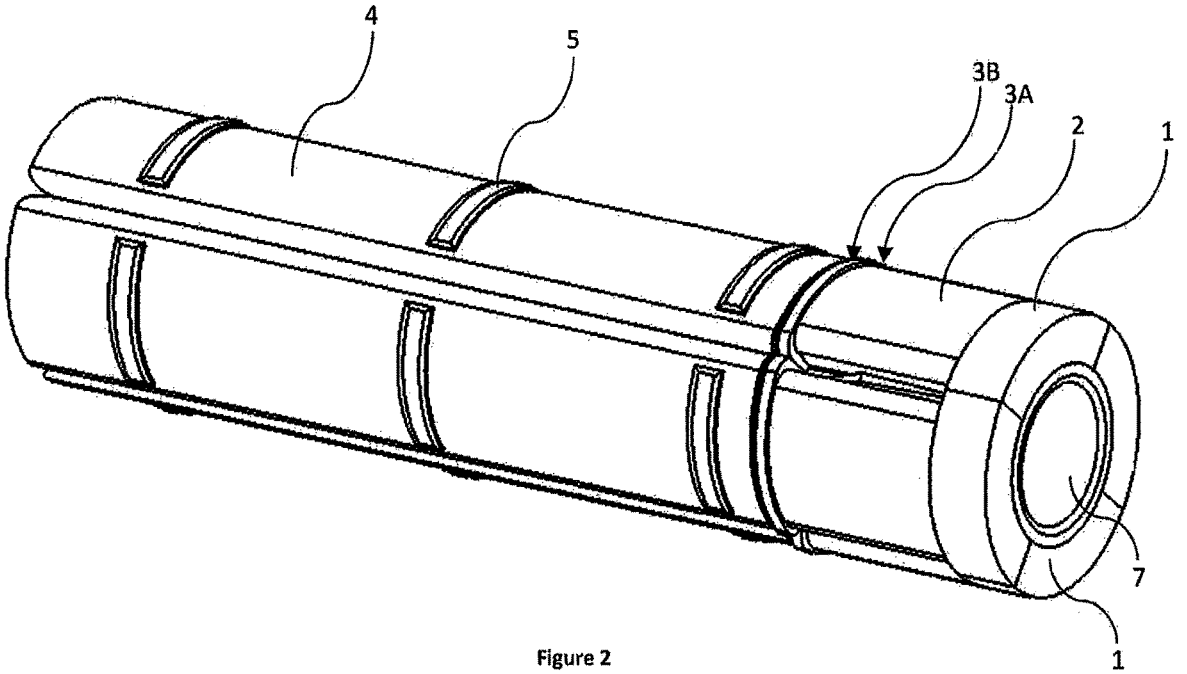
FIG. 2 is a rear isometric view of the embodiment of FIG. 1.
Figure 3:
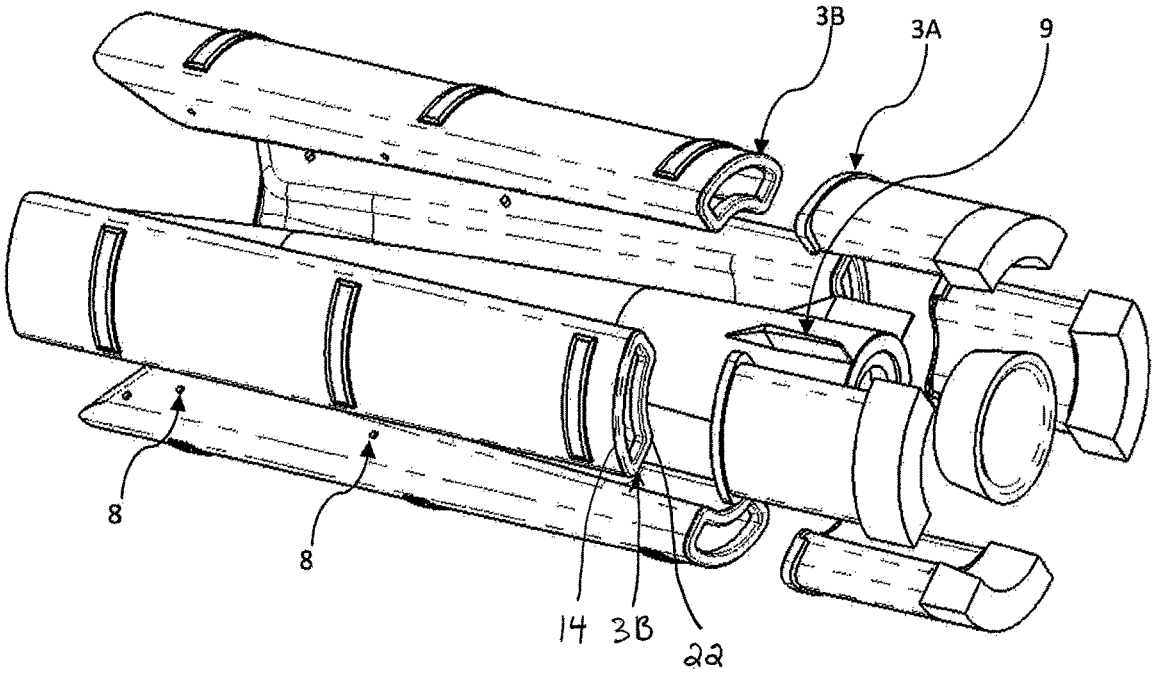
FIG. 3 is an exploded view of the integrated launch package shown in FIG. 2, shown from the rear end.
Figure 4:
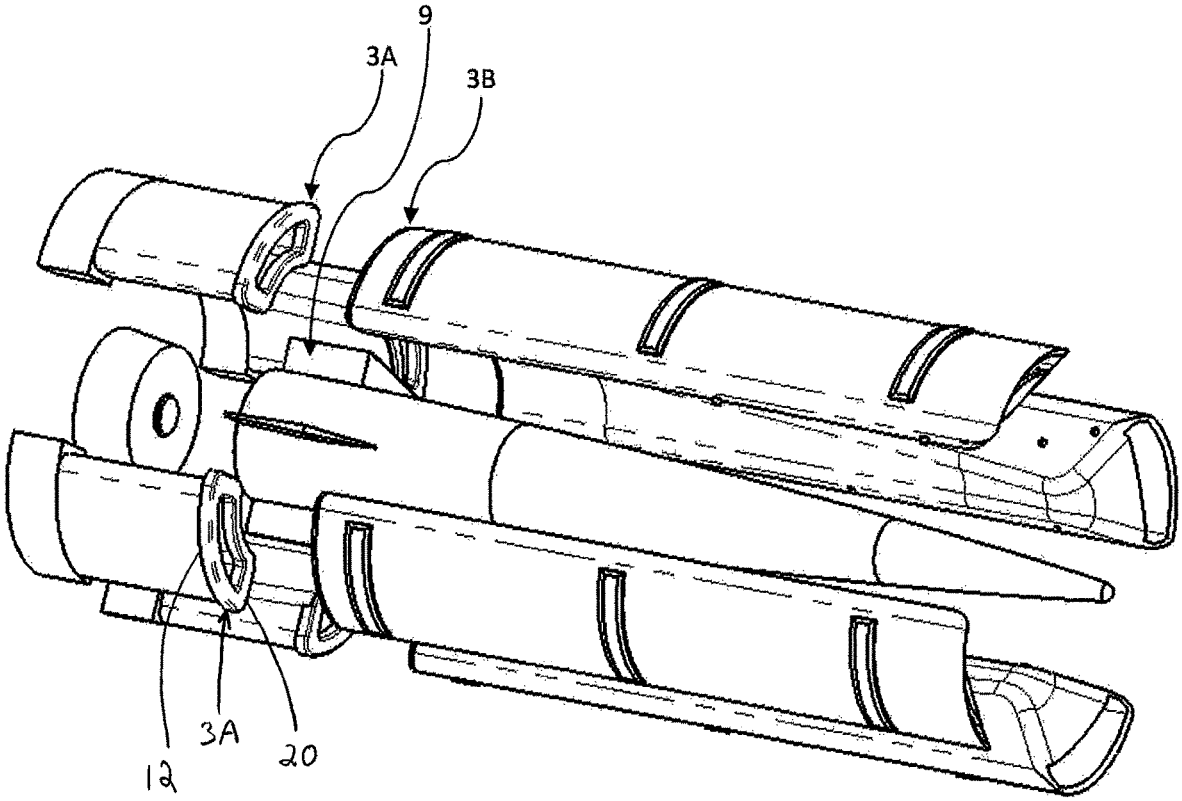
FIG. 4 is an exploded view of the integrated launch package shown in FIG. 2, shown from the front end.

Referring to the drawings in more detail, FIGS. 1-5 illustrate an assembly of one example of an integrated launch package 10 with pusher inserts 1 disposed at the rear end of the launch package 10. The aft petals 2 are in contact with the insert pusher 1, and the aft slip plates 3A are mounted to the front surfaces 14 of the aft petals 2. The forward slip plates 3B are mounted to the rear surfaces 14 of the forward petals 4. The riders 5 are formed on the outer surface of the forward petals 4. The projectile 6 is surrounded by eight petals 2, 4. FIG. 2 is an illustration of the same launch package assembly depicted in FIG. 1 yet viewed from a different reference point, depicting the product according to the various embodiments described herein, and showing the pusher plate 7.

More specifically, in the embodiment shown in FIGS. 1-5, the aft petals 2 each have a front surfaces 12 with an aft slip plates 3A mounted thereon. The forward petals 4 have rear surfaces 14 with forward slip plates 3B mounted thereon. The front surfaces 20 of the aft slip plates 13 are adjacent to and in contact with the rear surfaces 22 of the forward slip plates 15. The adjacent surfaces 20 and 22 of the aft and forward slip plates have low coefficients of friction, thereby allowing isolating the forward petals 4 to rotate at a much slower angular rate during launch than the aft petals 2. This is the intent of the invention. In embodiments, the slip plates have a low surface energy.

Figure 5:
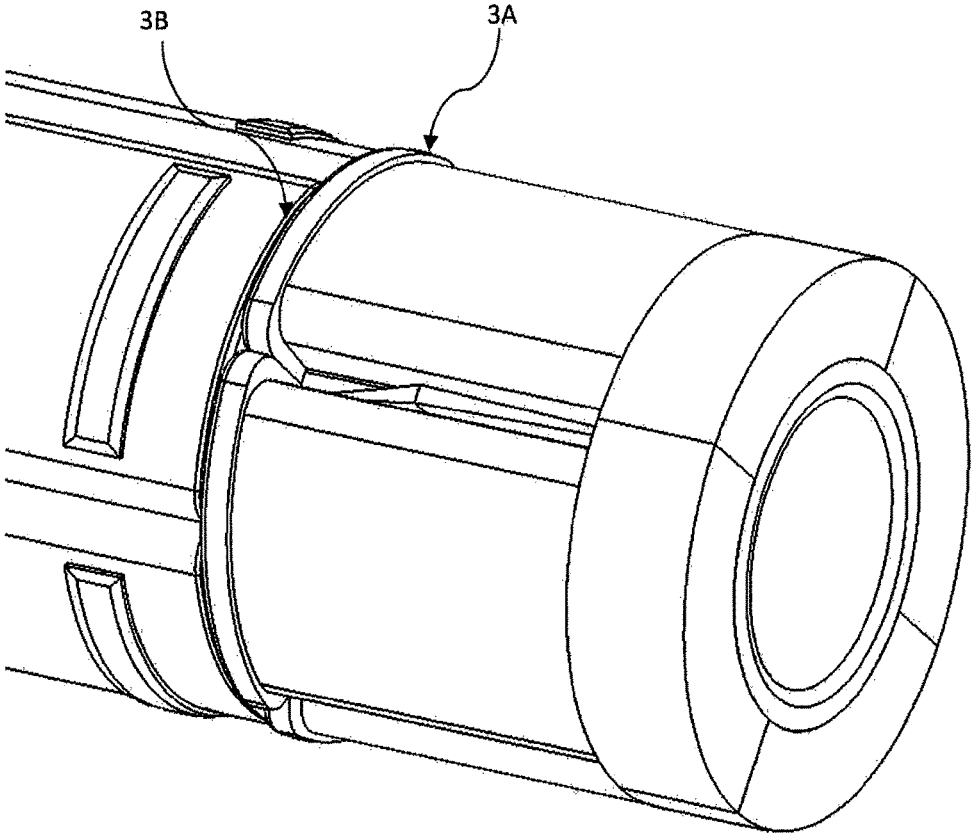
FIG. 5 shows detail of the rear end of the integrated launch package shown in FIGS. 1-4.

FIG. 3 is an exploded view of the integrated launch package shown in FIG. 2, highlighting the aft slip plate 3A, which is mounted to the forward end of the aft petal 2, forward slip plate 3B, which is mounted to the rear end surface 14 of the forward petal 4 and projectile fins 9, which extend radially outwardly from the aft end portion of the projectile 6. FIG. 4 is an illustration of the same launch package assembly depicted in FIG. 3 yet viewed from a different reference point highlighting the aft slip plate 3A, forward slip plate 3B, and projectile fins 9, also depicting the product according to the various embodiments described herein. FIG. 5 is an illustration of the launch package at an arbitrary time during a launch depicting the how the petals and slip plate are rotated approximately 45 degrees relative to each other at this instant.

In embodiments, as a result of the inclusion of the slip plates, the forward petals 4 rotate more slowly than the aft petals 4. In some cases, the forward petals 4 do not rotate. The aft petals rotate at the rotational speed of the projectile upon launch. The aft petals have a shorter length than the forward petals, which enables the aft petals to have a relatively high torsional stiffness. Because the forward petals are not subject to high angular acceleration, they are not required to have a high torsional stiffness. By using short aft petals relative to the length of the forward petals, the torsional stiffness of the aft petals can be achieved using a variety of different materials of construction.

In some cases, the aft petals and forward petals are made from the same material. In other cases, the forward petals are made from a material that does not impart high rotational stiffness to the forward petals, while the aft petals comprise a material having high rotational stiffness.

The aft petals 2 can comprise a metal, metal composite, polymer, polymer composite, or another material that can withstand the fast rotation of the aft petals 2. The aft petals 2 can have an open or closed configuration. In the embodiment shown in FIGS. 1-5, the aft petals 2 have a closed, tubular configuration. The aft petals can have a solid, rather than hollow, inside as long as mass and performance requirements are met.

The forward petals 4 can comprise a metal, metal matrix composite, polymer, polymer composite, or another material that can withstand the torsional stresses of the forward petals 4. The forward petals 4 can have an open or closed configuration. In the embodiment shown in FIGS. 1-5, the forward petals 4 have a closed, tubular configuration. The forward petals can have a solid, rather than hollow, inside as long as long at mass and performance requirements are met. In embodiments, the forward petals have open cross sectional areas and the aft petals have closed cross sectional areas. The reverse configuration also could be used.

The slip mechanisms, such as slip plates, can be integrally formed with the petals or can be separate components that are mounted on the petals, or sandwiched between two adjacent components. In embodiments, the slip plates comprise a low surface energy material, and/or a low coefficient of friction material. In some cases, the slip plate mechanism comprises thermoplastic materials, thermoset materials, reinforced fiber polymer composites, metal, ceramics, and hybrids thereof. Non-limiting examples of suitable low coefficient of friction materials include fluorinated polymers such as polytetrafluoroethylene (PTFE), silicones, including polysiloxanes, such as polydimethylsiloxane, carbon, including graphite, tungsten-containing materials, molybdenum-containing materials, ceramics, etc. The slip plates can be rigid or flexible, and can be separate from an adjacent component or mounted to an adjacent component. Additionally, the slip mechanism can be a low coefficient of friction and/or low surface energy coating layer formed on another component. In embodiments, the slip mechanism, or a section of the slip mechanism, can be changed from a solid to a liquid or melt at the time of launch due to pressure, heat and/or friction.

In embodiments with forward and aft petals, there is a requirement to have aft petals separate from the main forward petals because fins are part of the projectile and rotate with projectile. These aft sabot petals need to rotate in phase with the fins. So, there is one set of four short aft petal-like tubes that rotate with the projectile to protect the fins during the launch event, and a set of four forward petals in the forward section of the ILP. These forward petals are the petals that are isolated from the torsional loads. Where the aft and forward petals meet there is a slipping mechanism that allows for relative rotation between the aft and forward petals. The slip mechanism (such as one or two slip plates) has low coefficient of friction surfaces on this slip plate interface. In some cases, the aft petals have aft slip plates, the forward petals have forward slip plates, and where these plates touch they easily slip when the projectile begins to rotate. When the ILP is launched, the aft petals rotate at a spin rate identical to the projectile yet slipping occurs at the interface thereby isolating the forward petals from rotating. The aft petals and aft slip plates continue rotating angularly with the projectile during the entire in-bore launch event. With the aft petals being short, their rotational inertia is relatively insignificant thus the resulting torsional stresses are low. The long forward petals have a relatively large rotational inertia yet undergo minimal torsional stress since they undergo minimal angular acceleration. Having no torsional load the forward petals can have a greatly simplified design and be a different geometry than the aft petals. They may have thinner walls, and may use lower strength material. Due to the reduced loads and therefore lower risk of failure, the forward petals do not require demanding or complex composite architecture, and have appreciably reduced materials cost. Various designs and methods exist for this slip sabot interface and shall be custom engineered for each unique ILP application.

FIGS. 6-7 are illustrations of a different launch package 110. These figures show a slip sabot system for a projectile or launch package that does not have fins or canards. Therefore, there may be just one full-length set of sabot petals. The sabot petals can be the entire length of the projectile, or the merely the length that is functionally required. In these cases, the petals mate up against the pusher inserts and it is at that interface where the slip mechanism is integrated. The torsional stresses in the petals 111 are reduced due the slip mechanism at this location. Compared to the embodiment of FIGS. 1-5, there is no need for an aft and forward set of petals. In this example, the pusher components mate against the petals and slip occurs at that interface. Unlike example one, the petals in example two are not be mechanically interlocked with the pusher plate. Compared to example one, the launch package of example two only needs one set of petals rather than distinct fore and aft sets of petals.

For torsional stiffness of a device such as these sabot petals, the angular twist of each petal is defined by $\theta = TL/JG$, where $\theta$ is the angle of twist in radians, T is the applied Torque to each petal, L is the length of the object (petal), J is the torsional constant each petal, and G is the modulus of rigidity (shear modulus) of the material. For example one, the angle of twist is small since the aft petals are short in length and have low mass thus they will have low torsional stress. The forward petals in example one are longer and have a larger mass yet since they are isolated from rotating fully, due to the slip mechanism, they also undergo low torsional stress; this is the essence of the disclosed embodiments. For example two, these petals are longer than the petals in example one, and they have a larger mass, however since they are partially or completely isolated from rotating then the angle of twist of each petal relative to itself is insignificant since the resulting torsional stress is effectively non-existent.

The disclosed embodiment uses mated flat disks as slip plates that have a low coefficient of friction between them, and when in use decrease and/or remove the high torsional loads induced in sabots when launched in rifled bore guns. When a sub-caliber projectile is fired in a large bore gun with rifling grooves, the sabot, while carrying or pushing, and guiding the projectile, also rotates with the projectile. It is the intent of this disclosure to provide features, such as the slip plates, to isolate the sabot from rotating with the projectile. The methods described herein allow the projectile to rotate as necessary yet the sabot itself can be isolated using the slip plate techniques.

In embodiments, the slip mechanism can be a layer that melts into a liquid upon launch, and the liquid provides lubrication between the adjacent surfaces. In embodiments, the slip surface(s) of the slip mechanism is a solid layer or plate with a surface that has/have a static coefficient of friction ($\mu s$) in the range of about 0.01 to about 0.05.

When the projectile is fully inserted into the gun, a cylindrical cartridge containing the gun powder (propellant) is placed in bore seated against the aft surface of the insert pushers 1 and pusher plate 7. When the cartridge is installed, the breech of the gun is closed and the system is ready for firing. Upon firing the propellant ignites and becomes a high temperature gas that thermally expands, and while doing so applies pressure on the pusher inserts 1 and pusher plate 7 which begins the load transfer path to accelerate the entire launch package. As the propellant continues expanding and applying pressure onto the pusher insert and pusher plate faces, the projectile launch package velocity increases. Upon muzzle exit the launch package has then reached its maximum velocity and heads down range to the target. While in-bore, the outer surfaces of the pusher inserts 1 have an additional component mounted to its outer surface called an obturator (a seal) that becomes interlocked with the bore rifling grooves. Neither this seal nor gun bore are shown in these figures. Since all the launch package components are initially interlocked with each other, the entire launch package therefore rotates as a whole as the obturator is forced to rotate with rifling grooves. The pusher inserts 1 rotate at a frequency dependent on the rifle pitch and velocity at that instant. As the launch package velocity increases, so does the angular velocity. To increase the angular velocity there is angular acceleration; it is this angular acceleration that induces the torsional stress on the launch package components. This embodiment provides a method to isolate the forward petals from the angular acceleration.

In embodiments, torsional stiffness does not have to be elevated by geometric techniques, and thus either open cross-section petals or closed cross-section petals can be used. The figures herein show closed cross-section sabot petals (body of revolution) as a method for increased torsional stiffness via geometry, but that methodology is not required.

A number of alternatives, modifications, variations, or improvements therein may be subsequently made by those skilled in the art, which are also intended to be encompassed by the following claims.

What is claimed is:

1. A sabot for a sub-caliber projectile, comprising:

a plurality of forward petals, each having a front surface and a rear surface, and a plurality of aft petals, each having a front surface and a rear surface, and a slip mechanism comprising slip plates mounted to at least one of:

the rear surfaces of the forward petals, and the front surfaces of the aft petals, the slip plates being configured to contact an adjacent surface prior to launch and to enable the forward petals to angularly accelerate at a slower rate than the projectile upon launch of the projectile.

2. The sabot of claim 1, wherein the slip mechanism is configured to enable the forward petals to angularly accelerate at a slower rate than the aft petals upon launch of the projectile.

3. The sabot of claim 1, wherein the slip plates are mounted to only the rear surfaces of the forward petals.

4. The sabot of claim 1, wherein the slip plates are mounted to only the front surfaces of the aft petals.

5. The sabot of claim 1, wherein the slip plates are mounted to both the rear surfaces of the forward petals and the front surfaces of the aft petals.

6. The sabot of claim 1, wherein the forward petals have a greater length than the aft petals.

7. The sabot of claim 1, wherein the sabot includes a base configured to support an aft end of the projectile and the aft petals are in contact with, but not connected to, the base prior to launch.

8. The sabot of claim 1, wherein at least some of the petals have open cross-sectional areas.

9. The sabot of claim 1, wherein at least some of the petals have closed cross-sectional areas.

10. An assembly, comprising a sub-caliber projectile, a sabot surrounding the projectile, the sabot comprising:

a plurality of forward petals and a plurality of aft petals, each petal having a front surface and a rear surface, and a slip mechanism comprising slip plates mounted to at least one of:

the rear surfaces of the forward petals, and the front surfaces of the aft petals, each slip plate being in contact with a surface that is configured to accelerate rotationally at a different rate than the slip plate, and a pusher plate disposed proximate an aft end of the sabot.

11. The assembly of claim 10, wherein the projectile is an arrow-type projectile.

12. The assembly of claim 10, wherein the projectile does not include fins.

13. A system comprising the sabot of claim 1.

14. The sabot of claim 4, wherein the forward petals have a greater length than the aft petals.

15. The sabot of claim 1, wherein the slip plates are formed from at least one member selected from the group consisting of thermoplastic materials, thermoset materials, reinforced fiber polymer composites, ceramics, and hybrids thereof.

16. The sabot of claim 1, wherein the slip plates have an outer surface with a static coefficient of friction (μs) in the range of 0.01 to 0.05.

17. The assembly of claim 10, wherein the slip plates are formed from at least one member selected from the group consisting of thermoplastic materials, thermoset materials, reinforced fiber polymer composites, ceramics, and hybrids thereof.

18. The assembly of claim 10, wherein the slip plates have an outer surface with a static coefficient of friction (μs) in the range of 0.01 to 0.05.

19. The assembly of claim 10, wherein the forward petals have a greater length than the aft petals.

20. The assembly of claim 10, wherein the slip plates are mounted to both the rear surfaces of the forward petals and the front surfaces of the aft petals.

* * * * *